US008474352B2

(12) United States Patent
Eggert et al.

(10) Patent No.: US 8,474,352 B2
(45) Date of Patent: Jul. 2, 2013

(54) OPEN END WRENCH HEAD

(75) Inventors: Daniel M. Eggert, Kenosha, WI (US); Jonathan M. Andersen, Racine, WI (US)

(73) Assignee: Snap-On Incorporated, Kenosha, WI (US)

( * ) Notice: Subject to any disclaimer, the term of this patent is extended or adjusted under 35 U.S.C. 154(b) by 12 days.

(21) Appl. No.: 13/213,463

(22) Filed: Aug. 19, 2011

(65) Prior Publication Data

US 2013/0042725 A1 Feb. 21, 2013

(51) Int. Cl.
*B25B 13/08* (2006.01)

(52) U.S. Cl.
USPC ..... 81/119; 81/125.1; 81/124.3; 7/133

(58) Field of Classification Search
USPC ..... 81/119–125.1, 186, 300, 418–426.5
See application file for complete search history.

(56) References Cited

U.S. PATENT DOCUMENTS

| | | | | |
|---|---|---|---|---|
| 1,261,565 | A | 4/1918 | Leitner | |
| 1,393,399 | A * | 10/1921 | Schlehr | 81/125.1 |
| 1,689,585 | A | 10/1928 | Haschart | |
| 1,954,141 | A * | 4/1934 | Miquelon | 81/124.3 |
| 2,332,602 | A | 10/1943 | Rosenbloom | |
| 2,526,180 | A * | 10/1950 | White | 7/133 |
| 2,687,056 | A * | 8/1954 | Foor | 81/125.1 |
| 3,215,009 | A | 11/1965 | Peterson | |
| 3,283,623 | A | 11/1966 | Neff | |
| 5,074,171 | A | 12/1991 | Annis et al. | |
| 5,381,710 | A | 1/1995 | Baker | |
| 5,551,322 | A | 9/1996 | Mikic et al. | |
| 5,604,947 | A * | 2/1997 | Bates et al. | 7/133 |
| 6,715,383 | B1 | 4/2004 | Hsien | |
| 6,745,648 | B2 | 6/2004 | Stier | |
| D519,009 | S | 4/2006 | Hsieh | |
| 7,066,057 | B2 | 6/2006 | Hsien | |
| 7,146,884 | B2 | 12/2006 | Chaconas et al. | |
| D552,440 | S | 10/2007 | Wu | |
| D631,311 | S | 1/2011 | Yang | |
| D632,147 | S | 2/2011 | Yang | |
| 2005/0081686 | A1 | 4/2005 | Hsien | |
| 2006/0137494 | A1* | 6/2006 | Wu | 81/119 |

FOREIGN PATENT DOCUMENTS

| | | |
|---|---|---|
| CH | 206491 | 11/1939 |
| DE | 20303017 | 6/2003 |
| FR | 2850310 | 7/2004 |

OTHER PUBLICATIONS

International Search Report and Written Opinion of International Searching Authority dated Oct. 16, 2012 of Applicant's corresponding PCT application.

* cited by examiner

*Primary Examiner* — Monica S. Carter
*Assistant Examiner* — Melanie Alexander
(74) *Attorney, Agent, or Firm* — Seyfarth Shaw LLP

(57) ABSTRACT

An open end wrench head including first and second jaws that are adapted to engage a workpiece located in a hard-to-reach area. The jaws can include a chamfered portion on the end of the jaws that allows the wrench to be presented at an angle to the workpiece and still maximize the engagement area between the wrench and the workpiece.

18 Claims, 2 Drawing Sheets

OPEN END WRENCH HEAD

FIELD OF THE INVENTION

The present application relates generally to hand tools. More particularly, the present application relates to an open end wrench head design with an increased workpiece engagement area when presented at an angle to the workpiece.

BACKGROUND OF THE INVENTION

Open end wrenches are well known hand tools used to apply torque to a workpiece. The wrench head includes two jaws that grip a workpiece, such as a hexagonal bolt, and rotate the workpiece into engagement with a building material or nut. The jaws are typically aligned in the same direction as a wrench handle to allow the user to apply maximum torque to the workpiece in a simple and convenient structural configuration.

Many workpieces are located in hard-to-reach places that force the user to angle the wrench relative to the workpiece. For example, as shown in FIG. 5, a conventional wrench 500 may have difficulty gripping a workpiece when presented at such an angle because the jaws of the wrench 500 are unable to extend along the horizontal periphery of the workpiece 200. As a result, the conventional wrench 500 cannot obtain a large engagement area with the workpiece 200 and requires many carefully maneuvered turns of the wrench 500 before the workpiece 200 can be rotated into place.

Several prior art wrenches have attempted to resolve the above issue. For example, U.S. Pat. No. 6,715,383 to Hsien discloses a wrench with a wrench head having jaws that are angled with respect to an engagement surface. The angled nature of the jaws allows the wrench to obtain access to hard-to-reach workpieces while still allowing a portion of the bottom surface of the wrench head to contact the working surface and improve the engagement area between the wrench head and the workpiece. However, the wrench head in Hsien involves a large angle of inclination that also reduces the thickness of the jaws in an area that contacts the workpiece. As a result, the engagement area between the wrench and the workpiece is reduced, and the jaws are unable to suitably apply torque at the engagement area.

SUMMARY OF THE INVENTION

The present application relates to an open end wrench head design that is shaped and sized to engage a hard-to-reach workpiece while the thickness of the jaws at the engagement area is not reduced. In particular, the present application relates to a wrench head including a first surface and a second surface opposite the first surface; an open ended receiving portion including first and second jaws that are adapted to engage a workpiece, the workpiece adapted to be driven into a working surface; and a chamfer provided on at least one of the first and second surfaces, wherein the chamfer is sized and shaped such that a thickness of the wrench head is not reduced in the receiving portion when the chamfer is disposed flush against the working surface.

In addition, the present application discloses a wrench including a handle; a head coupled to the handle and adapted to engage a workpiece, the workpiece adapted to be driven into a working surface, the head including a first surface and a second surface opposite the first surface; an open ended receiving portion including first and second jaws that are adapted to engage the workpiece; and a chamfer provided on at least one of the first and second surfaces, wherein the chamfer is sized and shaped such that a thickness of the wrench head is not reduced in the receiving portion when the chamfer is disposed flush against the working surface.

Also, the present application discloses a combination including a workpiece; and a wrench that includes a handle; a head coupled to the handle and adapted to engage the workpiece, the workpiece adapted to be driven into a working surface, the head including a first surface and a second surface opposite the first surface; an open ended receiving portion including first and second jaws that are adapted to engage the workpiece; and a chamfer provided on at least one of the first and second surfaces, wherein the chamfer is sized and shaped such that a thickness of the wrench head is not reduced in the receiving portion when the chamfer is disposed flush against the working surface.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages should be readily understood and appreciated.

DETAILED DESCRIPTION OF THE PREFERRED EMBODIMENTS

Figure 1:
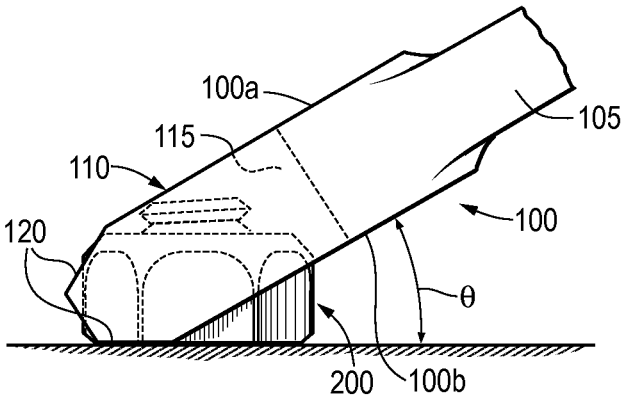
FIG. 1 is a side view of a wrench according to the present application.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

The present application discloses an apparatus, method and system for transmitting torque to a workpiece located in a hard-to-reach area. The wrench according to the present application allows access to the workpiece while maximizing an engagement area without reducing the thickness of the jaws in the engagement area.

As shown in FIG. 1, the wrench 100 includes a handle 105 and a head 110. The head 110 includes a first surface 100*a* and a second surface 100*b* opposite the first surface 100*a*, and also includes a receiving area 115 that is sized and shaped to receive a workpiece 200 and apply torque to the workpiece 200. A chamfer 120 can be provided on the ends of jaws 125 that extend from the receiving area 115 to increase the engagement area between the wrench 100 and the workpiece 200 when the wrench 100 is presented at an angle to the workpiece 200.

The handle 105 can be any shape that allows a user to grip the wrench 100 and apply torque to the workpiece 200. For example, the handle 105 can be cylindrical, rectangular, or any other shape that ergonomically fits the hand of a user. In an embodiment, the handle 105 has a thickness that is smaller than a thickness of the head 110.

As discussed above, the head 110 can include a first surface 100*a* and a second surface 100*b* opposite the first surface 100*a*. The first surface 100*a* and the second surface 100*b* can be substantially parallel to one another and can be generally aligned with the extending direction of the handle 110. That is, the head 110 and the handle 105 can be disposed in a substantially straight line and not at an angle to one another. Of course, the head 110 can be angled relative to the handle 105 or can be rotatably coupled to the handle 105 without departing from the spirit and scope of the present application.

The head 110 also includes the receiving area 115 that applies torque to the workpiece 200. A rear portion of the receiving area 115 includes the jaws 125 that grip the workpiece 200 and apply torque to the workpiece 200. The remainder of the jaws 125 extend away from the workpiece 200 and end at the chamfer 120 provided at the end of each jaw 125.

Figure 2:
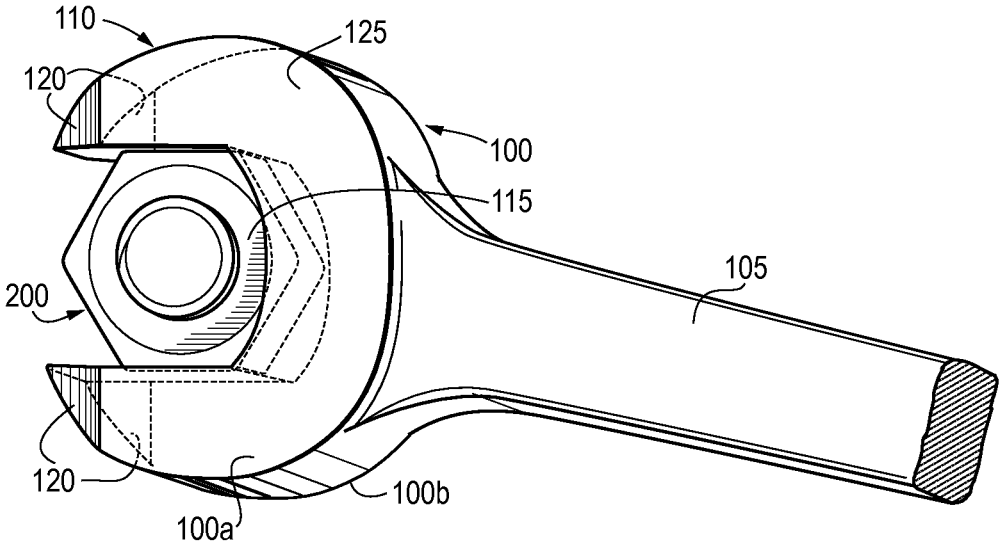
FIG. 2 is a top view of the wrench according to the present application.

The chamfer 120 is sized and shaped to permit the wrench 100 to engage a workpiece 200 when the wrench 100 is presented at an angle to the workpiece 200. The exact angle and dimension of the chamfer 120 can be varied so long as the receiving area 115, which contacts the workpiece 200, maintains a substantially constant thickness in the area that engages the workpiece 200. As shown in FIGS. 1 and 2, the chamfer 120 is provided on both the first surface 100*a* and the second surface 100*b*, but it should be appreciated that the chamfer 120 can be provided on only one of the first 100*a* and second 100*b* surfaces without departing from the spirit and scope of the present application.

Figure 5:
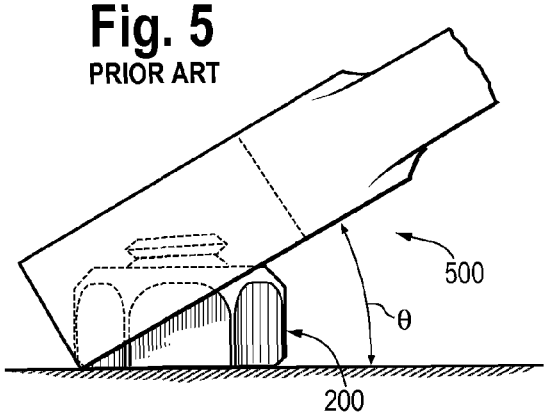
Fig. 5 PRIOR ART
FIG. 5 is a side view of a conventional wrench.

In an embodiment, the chamfer 120 is presented at an angle of between approximately 20 to 30 degrees with respect to the working surface, i.e., the surface to which the workpiece 200 is to be fastened. The present inventors discovered that the above range of chamfer angles provides the greatest engagement area between the wrench 100 and the workpiece 200 when the wrench 100 is presented at an angle to the workpiece 200. For example, the present inventors discovered that a chamfer angle of approximately 30 degrees resulted in a 21% increase in contact area for a first jaw 125 and a 61% increase in contact area for a second jaw 125 relative to the conventional wrench 500 configuration illustrated in FIG. 5. When presented at an angle flatter than approximately 20 degrees, the present inventors found that the advantages of the chamfer 120 were unexpectedly reduced, and that the engagement area between the wrench 100 and the workpiece 200 was only increased slightly while the ability to engage hard-to-reach workpieces 200 was not dramatically increased.

The workpiece 200 can be any piece of hardware that can be rotated by the wrench 100. For example, the workpiece 200 can be a bolt, nut, screw, pin, pipe, or any other workpiece, and can have a head shaped as a hexagon, square, circle, or any other shape. In an embodiment, the workpiece 200 is a 10 mm hex-shaped bolt or nut.

Figure 3:
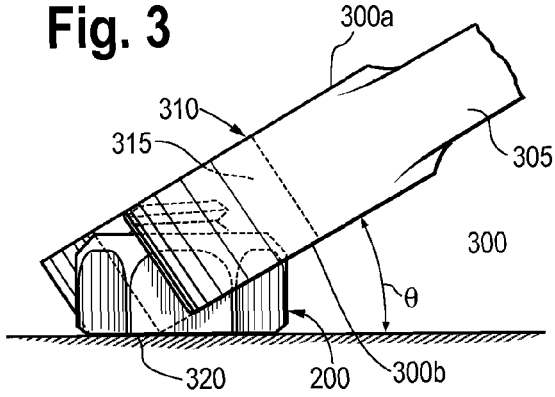
FIG. 3 is a side view of a second embodiment of a wrench according to the present application.
Figure 4:
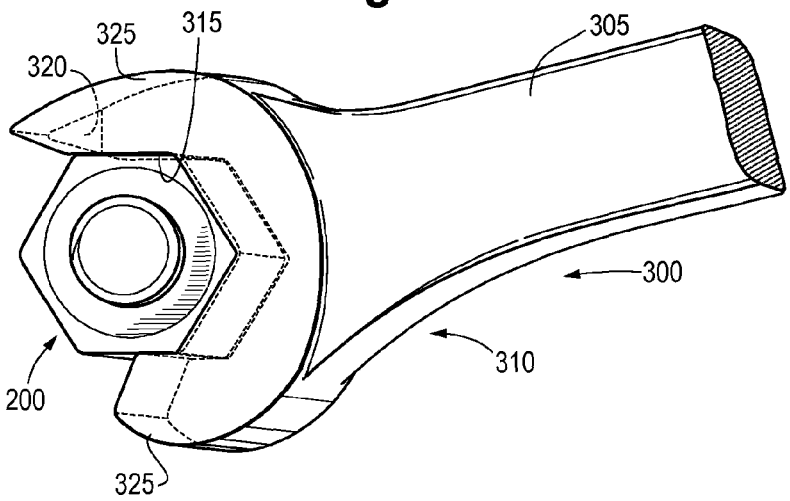
FIG. 4 is a top view of the second embodiment of the wrench according to the present application.

FIGS. 3 and 4 illustrate a second embodiment of a wrench 300 according to the present application. The wrench 300 of FIGS. 3 and 4 is similar to the wrench 200 discussed above, where similar numbers represent similar elements. The wrench 300 includes a handle 305 and a head 310 with a first surface 300*a* and a second surface 300*b* opposite the first surface 300*a*. The wrench 300 also includes a receiving area 315 adapted to engage a workpiece 200 and apply torque to the workpiece 200. In an embodiment, a chamfer 320 is provided on one of the jaws 325 and allows the wrench to engage a workpiece 200 when presented at an angle. Of course, both jaws 325 can include the chamfer 320, and/or both surfaces 300*a*, 300*b* can include the chamfer 320, without departing from the spirit and scope of the present application.

The main difference between the embodiment of FIGS. 3 and 4 and that of FIGS. 1 and 2 is that the wrench 300 is an open-ended ratchet wrench and, as a result, includes jaws 325 with different lengths. Due to the unequal length jaws 325 of the wrench, the short jaw 325 is unlikely to come into contact with the working surface if the working surface is substantially flat. As a result, the chamfer 320 can be applied to only one jaw 325 of the wrench 300. This configuration allows better maneuverability of the wrench 300 in both the horizontal and vertical directions.

The manner set forth in the foregoing description and accompanying drawings and examples, is offered by way of illustration only and not as a limitation. More particular embodiments have been shown and described, and it will be apparent to those skilled in the art that changes and modifications may be made without departing from the broader aspects of Applicant's contribution. The actual scope of the protection sought is intended to be defined in the following claims when viewed in their proper prospective based on the prior art.

What is claimed is:

1. A wrench head having a wrench head thickness comprising:

first and second opposing jaws having a first surface and a second surface opposite the first surface;

a receiving area defined by the first and second jaws and adapted to receive a workpiece that is adapted to abut a working surface, the receiving area having an open end, a rear portion, and a receiving area thickness; and a chamfer provided on the first surface, proximate to the open end and extending along the first surface and terminating between the open end and the rear end, the chamfer being sized and shaped to be disposed substantially flush against the working surface therein receiving the workpiece and to maintain the receiving area thickness constant relative to the workpiece.

2. The wrench head according to claim 1, wherein the chamfer is provided at an angle of approximately 20 to 30 degrees relative to the working surface.

3. The wrench head according to claim 1, wherein the chamfer is provided on both the first and second jaws.

4. The wrench head according to claim 1, wherein the first jaw is shorter than the second jaw.

5. A wrench comprising:

a handle;

a head having a head thickness coupled to the handle and adapted to engage a workpiece, the workpiece adapted to engage a working surface, the head including:

first and second opposing jaws having a first surface and a second surface opposite the first surface;

a receiving area defined by the first and second jaws and having an open end, a rear portion, and a receiving area thickness; and a chamfer provided on the first surface, proximate to the open end and extending along the first surface and terminating between the open end and the rear end, the chamfer being sized and shaped to be disposed substantially flush against the working surface therein receiving the workpiece and to maintain the receiving area thickness constant relative to the workpiece.

6. The wrench according to claim 5, wherein the chamfer is provided at an angle of approximately 20 to 30 degrees relative to the working surface.

7. The wrench according to claim 5, wherein the chamfer is provided on both the first and second jaws.

8. The wrench according to claim 5, wherein the handle has a handle thickness and the handle thickness is less than the head thickness.

9. The wrench according to claim 5, wherein the chamfer is provided on both of the first and second surfaces.

10. The wrench according to claim 5, wherein the first jaw is shorter than the second jaw.

11. A combination comprising:

a workpiece;

a handle; and a head having a head thickness coupled to the handle and adapted to engage a workpiece, the workpiece adapted to engage a working surface, the head including:

first and second opposing jaws having a first surface and a second surface opposite the first surface;

a receiving area defined by the first and second jaws and having an open end, a rear portion, and a receiving area thickness; and a chamfer provided on the first surface, proximate to the open end and extending along the first surface and terminating between the open end and the rear end, the chamfer being sized and shaped to be disposed substantially flush against the working surface therein receiving the workpiece and to maintain the receiving area thickness constant relative to the workpiece.

12. The combination of claim 11, wherein the chamfer is provided at an angle of approximately 20 to 30 degrees relative to a working surface.

13. The combination of claim 11, wherein the chamfer is provided on both the first and second jaws.

14. The combination of claim 11, wherein the handle has a handle thickness and the head has a head thickness, and the handle thickness is less than the head thickness.

15. The combination of claim 11, wherein the workpiece is a 10 mm diameter bolt or nut.

16. The combination of claim 11, wherein the jaws are substantially parallel with respect to one another.

17. The wrench head according to claim 11, wherein the first jaw is shorter than the second jaw.

18. The wrench head according to claim 11, wherein the chamfer is provided on only one of the first and second jaws.

* * * * *